United States Patent [19]

McCormick

[11] Patent Number: 4,989,506

[45] Date of Patent: Feb. 5, 1991

[54] CHARCOAL FILTER SYSTEM FOR A TRASH COMPACTOR

[75] Inventor: Michael J. McCormick, Danville, Ky.

[73] Assignee: Whirlpool Corporation, Benton Harbor, Mich.

[21] Appl. No.: 269,115

[22] Filed: Nov. 9, 1988

[51] Int. Cl.[5] ..... B30B 9/00; B30B 15/06

[52] U.S. Cl. ..... 100/90; 34/80; 55/473; 98/31.5; 100/229 A; 220/908; 312/31; 422/5

[58] Field of Search ..... 100/53, 229 A, 240, 100/70 R, 93 P, 90, 91, 102; 55/383, 384, 473; 98/1, 31.5; 312/31; 34/80, 82; 220/1 T; 422/5, 4

[56] References Cited

U.S. PATENT DOCUMENTS

| | | | |
|---|---|---|---|
| 3,071,867 | 1/1963 | Barber | 34/80 |
| 3,881,408 | 5/1975 | Valor | 100/229 A X |
| 4,008,658 | 2/1977 | Stock et al. | 100/91 X |
| 4,047,775 | 9/1977 | Wolbrink | 422/5 X |
| 4,064,203 | 12/1977 | Cox | 98/31.5 X |
| 4,273,037 | 6/1981 | Ruebesum | 100/229 X |
| 4,706,560 | 11/1987 | Capodicasa | 100/102 |

FOREIGN PATENT DOCUMENTS

| | | | |
|---|---|---|---|
| 3400421 | 7/1985 | Fed. Rep. of Germany | 220/1 T |

*Primary Examiner*—Philip R. Coe
*Assistant Examiner*—Stephen F. Gerrity
*Attorney, Agent, or Firm*—Mason, Kolehmainen, Rathburn & Wyss

[57] ABSTRACT

A charcoal filter system for a trash comparator includes a charcoal filter snap-fit to a first face of a mounting cover and a fan snap-fit to a second, opposite face of a mounting cover. The filter system is mounted in an opening formed on a front wall of a frame of the trash compactor without requiring the use of tools. A cabinet having a front wall with an opening aligned with the opening in the frame for the filter system includes a faceplate diverter snap-fit therein to direct air to the filter system from a trash receptacle mounted in openings in the frame and cabinet below the filter system.

39 Claims, 3 Drawing Sheets

CHARCOAL FILTER SYSTEM FOR A TRASH COMPACTOR

BACKGROUND OF THE INVENTION

1. Field of the Invention

The present invention relates to a trash compactor and more particularly to an improved activated charcoal filter system for a trash compactor wherein the filter system is easily accessible for repair and for replacement of the activated charcoal filter and further requires no tools for installation or removal.

2. Description of the Prior Art

Various air filtering devices are known such as shown in U.S. Pat. Nos. 2,317,840; 3,032,028; 3,577,710; 3,711,743; 4,339,250; 4,660,464; 3,686,836; 4,008,658; 4,199,333; and 4,706,560. Air filtering devices utilizing an activated charcoal filter are also known as shown in U.S. Pat. Nos. 2,362,933 and 3,496,704. There is a particular need to freshen the air in a trash compactor as depicted in U.S. Pat. No. 3,556,619. A known air filtering system for a trash compactor is shown in U.S. Pat. No. 3,881,408 wherein the system includes an activated charcoal filter mounted at the rear of the trash compactor on an outlet of a duct having an inlet on which a fan is mounted. Because this air filtering system is mounted at the rear of the trash compactor, the system is difficult to access for repair and for replacement of the activated charcoal filter.

SUMMARY OF THE INVENTION

In accordance with the present invention, the disadvantages of prior art filtering systems for trash compactors, as discussed above, have been overcome. The air filtering system of the present invention is located at the front of the trash compactor so that it is easily accessible for repair and for replacement of its filter and further requires no tools for its installation or removal.

The trash compactor of the present invention includes a frame having a front wall with a first opening formed therein to provide access to a trash receptacle that is mounted with respect to the frame for slidable movement through the first opening. A second opening is formed in the frame above the first opening for defining an air freshener area. A mounting cover is disposed over the second opening of the frame wherein the mounting cover is formed of molded plastic with a plurality of apertures arranged in a grid-like pattern to allow air to flow through the second opening. An activated charcoal filter is snap-fit onto a first face of the mounting cover over the apertures formed therein for filtering unfiltered air received from the trash receptacle. A fan is snap-fit onto a second face of the mounting cover for drawing air from the trash receptacle through the activated charcoal filter and apertures in the mounting cover and for recirculating the filtered air back to the trash receptacle.

The trash compactor further includes a cabinet member having a front wall disposed in front of the frame's front wall with an aperture formed in the cabinet member that is aligned with the second opening of the trash compactor's frame. A faceplate diverter is snap-fit in the aperture of the cabinet member for directing air from the trash receptacle to the air filtering system. Because of its snap-fit, the faceplate diverter is easily removed to provide access to the activated charcoal filter which can then be removed and replaced without the use of tools.

These and other objects, advantages and novel features of the present invention, as well as details of an illustrated embodiment thereof, will be more fully understood from the following description and the drawing.

DESCRIPTION OF THE PREFERRED EMBODIMENT

Figures 1, 3, 4, 5:
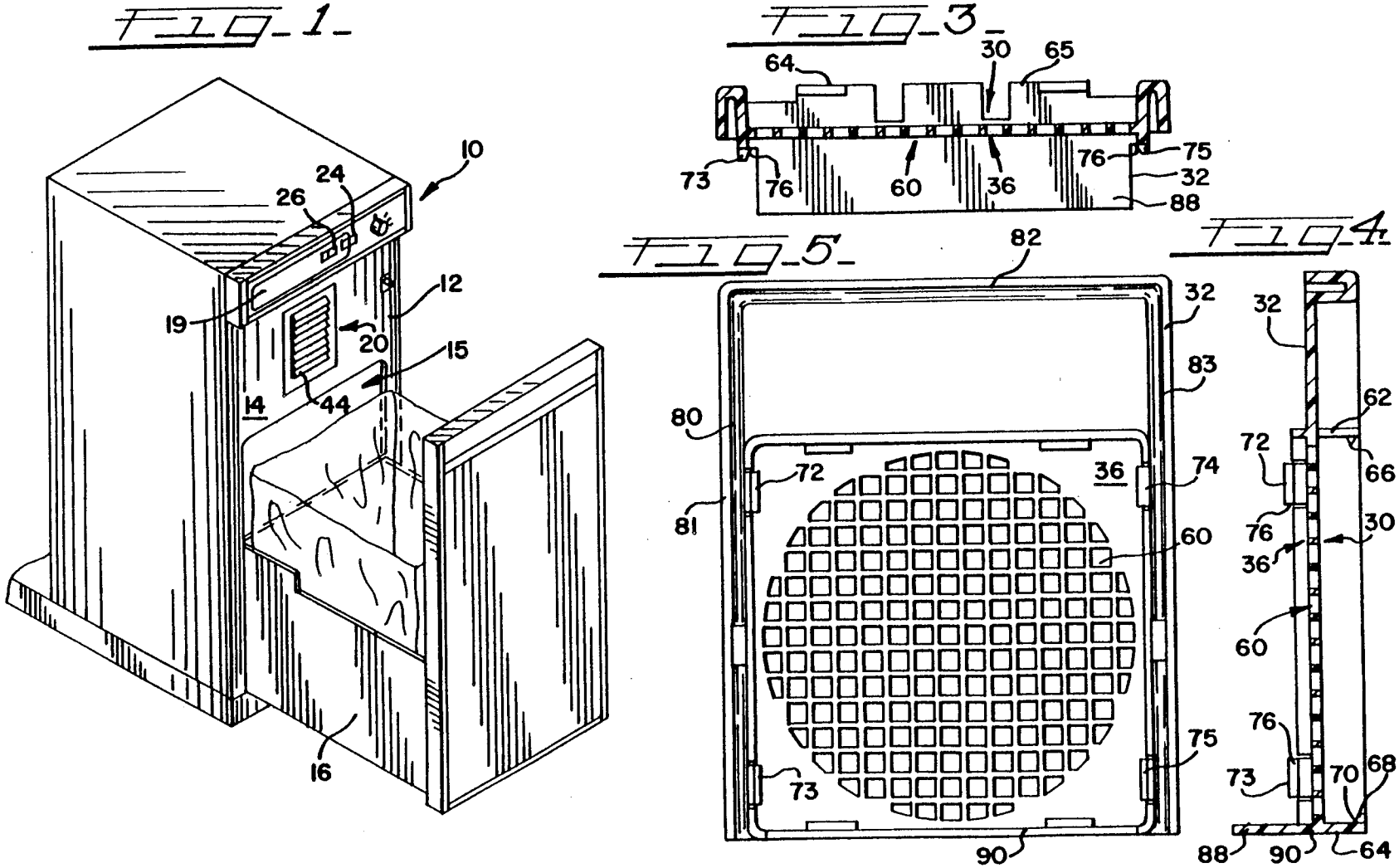
FIG. 1 is a perspective view of a trash compactor constructed in accordance with the principles of the present invention.
FIG. 3 is a top view of the mounting cover shown in FIG. 2 taken along lines 3—3.
FIG. 4 is a side view of the mounting cover shown in FIG. 2.
FIG. 5 is a rear view of the mounting cover shown in FIG. 2.
Figure 2:
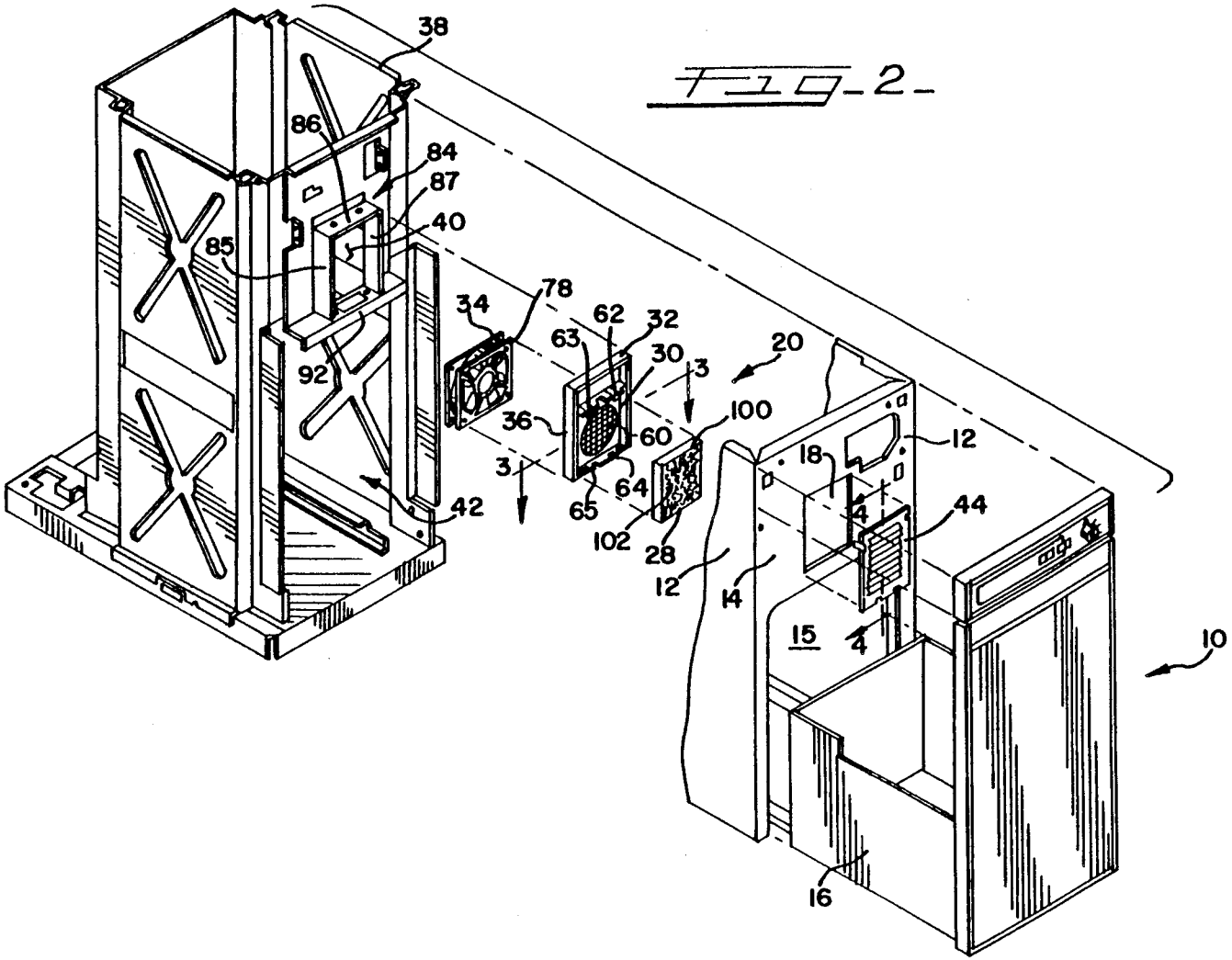
FIG. 2 is an exploded view of the trash compactor shown in FIG. 1.

A trash compactor 10, as shown in FIGS. 1 and 2, constructed in accordance with the principles of the present invention, includes a cabinet 12 with an opening 15 in a front wall 14 thereof to receive a trash container drawer 16 that forms a receptacle for trash. The trash container drawer 16 is mounted for slidable movement between a trash accepting position in which the trash container drawer 16 is open and a compacting position in which the trash container drawer 16 is closed. The cabinet 12 also includes a second smaller opening 18 positioned above the opening 15, wherein the opening 18 defines an air freshener area in which the activated charcoal filter system of the present invention, generally designated 20 is disposed. An escutcheon 19 mounted on the cabinet 12 above the filter system 20 includes a control switch 24 for operating the filter system 20 and a switch 26 for operating the trash compactor 10 to compact trash contained in the trash container drawer 16.

Figure 9:
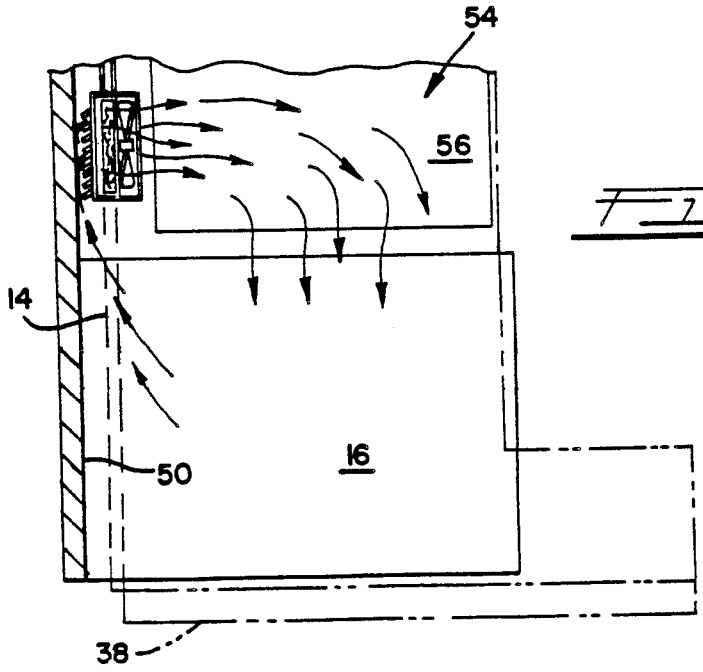
FIG. 9 is a diagram illustrating the flow of air for the trash compactor shown in FIG. 1.

The filter system 20 includes an activated charcoal filter 28 that is snap-fit onto a first face 30 of a mounting cover 32 over apertures 60 formed in the mounting cover in a grid-like pattern. The activated charcoal filter 28 includes a tin plate frame 100 surrounding a plurality of holes 102 in which activated charcoal is disposed. Alternatively, the filter material 28 may be formed of an activated charcoal impregnated non-woven polyester material. The filter system 20 also includes a fan-motor assembly 34 that is snap-fit onto a rear face 36 of the apertures 60 of the mounting cover 32 for drawing air through the filter 28 and the mounting cover 32 as discussed in detail below. The mounting cover 32 is secured to a frame 38 of the trash compactor 10, covering an opening 40 formed in the frame 38 and aligned with the opening 18 formed in the cabinet 12. The frame 38 has a second opening 42 aligned with the opening 15 in the cabinet 12 so as to allow the trash container drawer 16 to be moved between the trash accepting and trash compacting positions. The activated charcoal filter system 20 also includes a faceplate diverter 44 for directing unfiltered air from the trash container drawer 16 to the activated charcoal filter 28. As shown in FIG. 9, the inner front wall 50 of the trash container drawer 16 is spaced a distance from the front wall 14 of the cabinet 12 secured to the frame 38 when the trash container drawer 16 is closed. Unfiltered air from the trash container drawer 16 is thus allowed to flow through the opening 15 in the cabinet 12, up from the trash container drawer 16 and into the activated charcoal filter system 20 as directed by the faceplate diverter 44.

Figure 8:
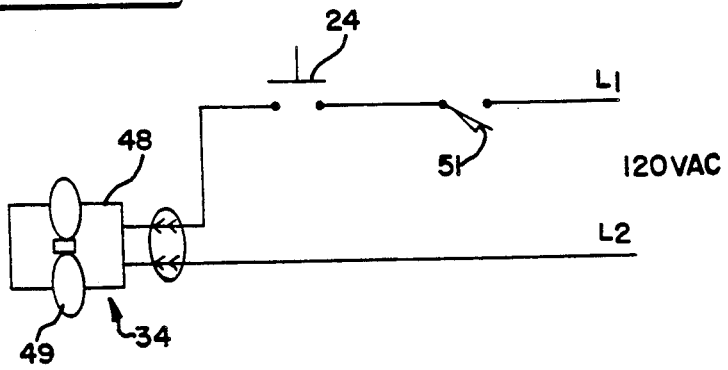
FIG. 8 is a schematic diagram illustrating the fan control of the trash compactor shown in FIG. 1.

To operate the filter system 20 for the trash compactor 10, the switch 24 is moved to its on position to connect the fan motor 48 of the fan assembly 34 to 120 volts A.C. as shown in FIG. 8. A safety switch 51 is connected in series with the on/off fan control switch 24 for disabling the fan assembly 34 and the fan control switch 24 when the trash container drawer 16 is open. When the switch 24 is moved to its on position with the trash container drawer 16 closed so as to power the fan motor 48, the fan 49 of the fan assembly 34 pulls air into the filter system 20. The air pulled into the filter system 20 by the fan assembly 34 is filtered as it passes through the activated charcoal filter 28 and is drawn through the apertures 60 of the mounting cover 32. The fan assembly 34 blows the filtered air into a ram area 54 of the trash compactor 10 in which a ram 56 is disposed for compacting trash contained in the trash container drawer 16. The air pulled by the fan assembly 34 into the filter system 20 creates a negative pressure in the trash container drawer 16; whereas the air blown into the ram area 54 by the fan assembly 34 creates a positive pressure in the ram area 54. The positive pressure in the ram area 54 causes the air in the ram area 54 to move downward into the trash container drawer 16 where it is recirculated up through the filtering system 20 by the fan assembly 34. As the air from the trash container drawer 16 passes through the activated charcoal filter 28, odors are removed.

The mounting cover, as shown in detail in FIGS. 2, 3, 4 and 5 has a one-piece construction and is formed of molded plastic wherein the mold for the mounting cover 32 is such as to require no cores or pulls. In order to snap-fit the activated charcoal filter 28 and the fan assembly 34 to the front face 30 and the rear face 36, respectively, of the mounting cover 32, the mounting cover 32 is provided with flexible members extending from both the front face 30 and the rear face 36. More particularly, a pair of flex tabs 62 and 63 extends outwardly from the front face 30 of the mounting cover 32 above the apertures 60. A pair of flex tabs 64 and 65 also extends outwardly from the front face 30 of the mounting cover 32 below the apertures 60, opposite the flex tabs 62 and 63. As shown in FIG. 3, for the flex tabs 62 and 64, each flex tab 62–65 has a retaining projection 66, 68 disposed at the outer end thereof that extends generally parallel to the front face 30 of the mounting cover 32 so as to maintain the activated charcoal filter 28 secured to the mounting cover. The retaining projection 66 of the flex tabs 62 and 63 has a triangular cross-section; whereas the retaining projection 68 for the flex tabs 64 and 65 has a generally rectangular cross-section with the inner surface 70 of the retaining projection 68 sloping slightly outwardly. From the rear face 36 of the mounting cover 32, a pair of flex tabs 72 and 73 extend outwardly on one side of the aperture grid area 60. A second pair of flex tabs 74 and 75 extend outwardly from the rear face 36 of the mounting cover 32 on another side of the aperture grid area 60 opposite the flex tabs 72 and 73. Each of the flex tabs 72–75 extending from the rear face 36 of the mounting cover 32 includes a retaining projection 76 disposed at the outer end thereof, the retaining projections 76 pointing inwardly, generally parallel to the rear face 36 so as to retain a faceplate 78 of the fan motor assembly 34 secured to the mounting cover 32.

The mounting cover 32 also includes a U-shaped slot 80 formed in three sides 81, 82 and 83 about the periphery of the rear face 36 of the mounting cover 32. The U-shaped slot 80 is adapted to receive a three-sided picture frame 84 comprised of flanges 85, 86 and 87, defining the side walls of the aperture 40 in the frame 38. A flange 88 extends from the fourth side or bottom 90 of the rear face 36 of the mounting cover 32, the flange 88 being received in the opening 40 on top of a flange 92 extending from the frame 38 and forming a bottom wall of the opening 40. The U-shaped slot 80 of the mounting cover 32 as well as the flex tabs 62–65 and 72–75 allow the activated charcoal filter 28, fan assembly 34 and mounting cover 32 to be installed on the frame 38 of the trash compactor 10 without the use of tools.

Figure 6:
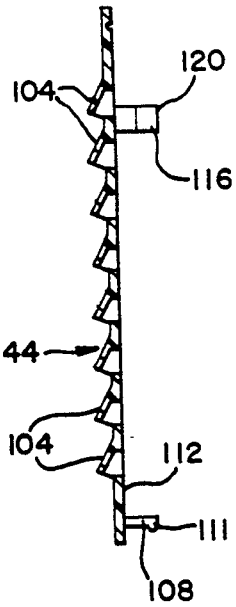
FIG. 6 is a side view of the faceplate diverter shown in FIG. 2.
Figure 7:
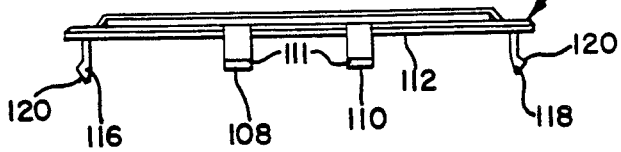
FIG. 7 is a bottom view of the faceplate diverter shown in FIG. 2.

The faceplate diverter 44 as shown in FIGS. 2, 6 and 7 includes a number of parallel horizontally extending vent fins 104 each of which extends outwardly and downwardly from the front face 106 of the faceplate diverter 44. The vent fins 104 direct air rising from the trash container drawer 16 into the filter system 20. As shown in FIGS. 6 and 7, a pair of flexible members or flex tabs 108 and 110 extends outwardly from the bottom of the rear face 112 of the faceplate diverter 44. Each of the flex tabs 108 and 110 has a retaining projection 111 formed at its outer end that extends downwardly and generally parallel to the faceplate diverter 44. A second pair of flexible members or flex tabs 116 and 118 extends from opposite sides of the rear face 112 of the faceplate diverter 44, near the top thereof, with retaining projections 120 formed at the ends thereof. The faceplate diverter 44 is molded in one piece of plastic wherein the mold for the faceplate diverter 44 further requires no pulls or cores.

The activated charcoal filter system 20 of the present invention is easily assembled and mounted on the trash compactor 10 without the use of any tools. In order to assemble the filter system 20, the activated charcoal filter 28 is snap-fit to the front face 30 of the mounting cover 32 by the flexible tabs 62–65. The fan assembly 34 is likewise snap-fit onto the mounting cover 32 by means of the flex tabs 72–75 extending from the rear face 36 of the mounting cover 32. After the fan assembly 34 and the activated charcoal filter 28 are snap fit onto the mounting cover 32, the mounting cover 32 is slid onto the picture frame 84 of the opening 40 formed in the frame 38 of the trash compactor 10. When the cabinet 12 is mounted on the compactor frame 38, the faceplate diverter 44 may be snap-fit into the opening 18 formed in the cabinet 12. To replace the activated charcoal filter 28, the faceplate diverter 44 is removed from the cabinet 12 without the need of tooling. With the faceplate diverter 44 removed from the cabinet 12, the activated charcoal filter 28 may be snapped out of the mounting cover 32 to easily remove and replace the activated charcoal filter 28.

Because the filter system 20 of the present invention is mounted on the front of the trash compactor it is easily accessible for repair and for replacement of the activated charcoal filter 28. Further, due to the flexible members formed on the mounting cover 32 and on the faceplate diverter 44 as well as the U-shaped slot 80 formed in the rear of the mounting cover 32, no tooling is required to install the filter system 20 on the trash compactor 10 or to remove the faceplate diverter 44 for access to the activated charcoal filter 28.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A deodorizing system for a trash compactor comprising:

a trash receptacle;

a frame having a front wall with first and second openings formed therein, said first opening being dimensioned to receive said trash receptacle therethrough;

means disposed in said second opening for filtering air passed therethrough; and means disposed to a rear of said filtering means for drawing air contained in the trash receptacle from the trash receptacle through said filtering means and blowing it back to said trash receptacle.

2. A deodorizing system for a trash compactor as recited in claim 1 wherein said filtering means includes activated charcoal.

3. A deodorizing system for a trash compactor as recited in claim 1 wherein said drawing and blowing means includes a fan.

4. A deodorizing system for a trash compactor as recited in claim 1 further including means disposed in front of said filtering means for directing air into said filtering means.

5. A deodorizing system for a trash compactor as recited in claim 1 further including means for covering said second opening, said covering means having a first face to which said filtering means is secured, a second face to which said drawing and blowing means is secured, and at least one aperture therein to allow air to flow from said filtering means to said drawing and blowing means.

6. A deodorizing system for a trash compactor as recited in claim 5 further including first means extending from said first face of said covering means for snap-fitting said filtering means to said covering means; and second means extending from said second face for snap-fitting said drawing and blowing means to said covering means.

7. A deodorizing system for a trash compactor as recited in claim 6 wherein said frame includes at least one flange extending outwardly therefrom; and said covering means includes a slot disposed in a side of a periphery of said covering means, said slot being adapted to accept said flange to secure said covering means to said frame.

8. A deodorizing system for a trash compactor comprising:

a trash receptacle;

a frame having a wall with first and second openings formed therein, said first opening being dimensioned to receive said trash receptacle therethrough;

a mounting cover disposed over said second opening, said mounting cover having first and second faces and at least one aperture defined therein to allow air to flow through said second opening;

means snap-fit onto the first face of said mounting cover over said aperture for filtering air passed therethrough from said trash receptacle; and means snap-fit onto the second face of said mounting cover over said aperture for drawing air contained in said trash receptacle from said trash receptacle through said filtering means and said aperture.

9. A deodorizing system for a trash compactor as recited in claim 8 wherein said mounting cover includes a pair of flexible members extending from said first face on opposite sides of said aperture for snap-fitting said filtering means to said mounting cover.

10. A deodorizing system for a trash compactor as recited in claim 9 wherein each of said flexible members includes a retaining projection extending generally parallel to said first face so as to maintain said filtering means secured to said mounting cover.

11. A deodorizing system for a trash compactor as recited in claim 8 wherein said mounting cover includes a pair of flexible members extending from said second face on opposite sides of said aperture for snap-fitting said air drawing means to said mounting cover.

12. A deodorizing system for a trash compactor as recited in claim 11 wherein each of said flexible members includes a retaining projection extending generally parallel to said second face so as to maintain said air drawing means secured to said mounting cover.

13. A deodorizing system for a trash compactor as recited in claim 8 wherein said mounting cover includes a first pair of flexible members extending from said first face on opposite sides of said aperture for snap-fitting said filtering means to said mounting cover; and a second pair of flexible members extending from said second face on opposite sides of said aperture for snap-fitting said air drawing means to said mounting cover.

14. A deodorizing system for a trash compactor as recited in claim 13 wherein each of said flexible members includes a retaining projection extending generally parallel to the face from which said member extends so as to maintain said filtering means and air drawing means respectively secured to said mounting cover.

15. A deodorizing system for a trash compactor as recited in claim 8 wherein said filtering means includes activated charcoal for removing odors from air passing through said filtering means.

16. A deodorizing system for a trash compactor as recited in claim 8 wherein said air drawing means includes a fan for circulating air from said trash receptacle through said filtering means and back to said trash receptacle.

17. A deodorizing system for a trash compactor as recited in claim 8 further including means disposed in front of said filtering means for directing air into said filtering means.

18. A deodorizing system for a trash compactor as recited in claim 17 wherein said air directing means is integrally formed in one piece of molded plastic.

19. A deodorizing system for a trash compactor as recited in claim 8 wherein said mounting cover means is integrally formed in one piece of molded plastic.

20. A deodorizing system for a trash compactor as recited in claim 8 wherein said mounting cover includes a plurality of apertures arranged to form a grid-like area on said mounting cover to allow air to flow through said second opening in said frame.

21. A deodorizing system for a trash compactor as recited in claim 8 wherein said frame includes at least one flange extending outwardly therefrom; and said covering means includes a slot disposed in a side of a periphery of said covering means, said slot being adapted to accept said flange to secure said covering means to said frame.

22. A deodorizing system for a trash compactor comprising:

a trash receptacle;

a frame having a front wall with a first opening formed therein, said first opening being dimensioned to receive said trash receptacle, said frame having a second opening formed therein above said first opening and defining an air freshener area;

a cabinet member secured to said frame and having a front wall disposed in front of said frame's front wall with a third opening formed therein and aligned with said first frame opening and with a fourth opening formed therein aligned with said second opening of said frame;

a mounting cover having first and second faces disposed over said second opening of said frame with at least one aperture formed therein to allow air to flow through said second opening;

means for filtering air mounted on the first face of said mounting cover over said aperture;

means mounted on the second face of said mounting cover over said aperture for drawing air through said filtering means and said aperture; and means secured to said cabined member in the fourth opening formed therein for directing air from said trash receptacle to said filtering means.

23. A deodorizing system for a trash compactor as recited in claim 22 wherein said mounting cover means is integrally formed in one piece of molded plastic.

24. A deodorizing system for a trash compactor as recited in claim 22 wherein said air directing means is integrally formed in one piece of molded plastic.

25. A deodorizing system for a trash compactor as recited in claim 22 wherein said mounting cover includes a plurality of apertures arranged to form a grid-like area on said mounting cover to allow air to flow through said fourth opening.

26. A deodorizing system for a trash compactor as recited in claim 22 wherein said mounting cover includes a pair of flexible members extending from said first face on opposite sides of said aperture for snap-fitting said filtering means to said mounting cover.

27. A deodorizing system for a trash compactor as recited in claim 26 wherein each of said flexible members includes a retaining projection extending generally parallel to said first face so as to maintain said filtering means secured to said mounting cover.

28. A deodorizing system for a trash compactor as recited in claim 22 wherein said mounting cover includes a pair of flexible members extending from said second face on opposite sides of said aperture for snap-fitting said air drawing means to said mounting cover.

29. A deodorizing system for a trash compactor as recited in claim 28 wherein each of said flexible members includes a retaining projection extending generally parallel to said second face so as to maintain said air drawing means secured to said mounting cover.

30. A deodorizing system for a trash compactor as recited in claim 22 wherein said mounting cover includes a first pair of flexible members extending from said first face on opposite sides of said aperture for snap-fitting said filtering means to said mounting cover; and a second pair of flexible members extending from said second face on opposite sides of said aperture for snap-fitting said air drawing means to said mounting cover.

31. A deodorizing system for a trash compactor as recited in claim 30 wherein each of said flexible members includes a retaining projection extending generally parallel to the face from which said member extends so as to maintain said filtering means and air drawing means secured to said mounting cover.

32. A deodorizing system for a trash compactor as recited in claim 22 wherein said filtering means includes activated charcoal for removing odors from air passing through said filtering means.

33. A deodorizing system for a trash compactor as recited in claim 22 wherein said air drawing means includes a fan for circulating air from said trash receptacle through said filtering means and back to said trash receptacle.

34. A deodorizing system for a trash compactor as recited in claim 22 wherein said air directing means includes means for snap-fitting said air directing means in said cabinet member's fourth opening to secure said air directing means to said cabinet member.

35. A deodorizing system for a trash compactor as recited in claim 34 wherein said snap-fitting means includes a plurality of flexible members extending from said air directing means.

36. A deodorizing system for a trash compactor as recited in claim 22 wherein said air directing means includes a plurality of downwardly and outwardly extending air vent fins for directing air from said trash receptacle to said filter.

37. A deodorizing system for a trash compactor as recited in claim 22 wherein said frame includes at least one flange extending outwardly therefrom; and said covering means includes a slot disposed in a side of the periphery of said covering means, said slot being adapted to accept said flange to secure said covering means to said frame.

38. A deodorizing system for a trash compactor as recited in claim 22 wherein said trash receptacle is movable between a trash accepting position and a closed position and includes a front wall extending in front of said air freshener area but spaced a distance therefrom when said trash receptacle is in said closed position, said air drawing means including a fan for creating a negative pressure in said trash receptacle and a positive pressure to the rear of said fan above said trash receptacle to circulate air from said trash receptacle through said air directing means, said filtering means and back to said trash receptacle.

39. A deodorizing system for a trash compactor comprising:

a cabinet having a front wall, a rear wall and a pair of side walls, said front wall having first and second openings defined therein;

a trash receptacle supported within said cabinet and dimensioned to be received into said cabinet through said first opening;

a front panel attached to said trash receptacle, said front panel being larger than said first and second openings and disposed outside said front wall, said front panel being movable between an open position permitting access to said trash receptacle and to a closed position preventing access to said trash receptacle and said second opening, said front wall and said front panel being spaced from each other when said front panel is in the closed position and cooperating to define a passageway between said first and second openings; and means including a filter and a fan for drawing air from said trash receptacle through said first opening, said passageway, second opening and said filter to thereby filter out any odors emanating from the trash receptacle.

* * * * *